US005273181A

United States Patent [19]

Gay

[11] Patent Number: 5,273,181

[45] Date of Patent: Dec. 28, 1993

[54] PLASTIC DRUM WITH DRAIN SUMP AND METHOD OF MAKING THE SAME

[75] Inventor: Raymond W. Gay, Marion, Ohio

[73] Assignee: Greif Bros. Corporation, Delaware, Ohio

[21] Appl. No.: 9,550

[22] Filed: Jan. 26, 1993

[51] Int. Cl.[5] ..... B65D 7/00

[52] U.S. Cl. ..... 220/601; 220/4.05

[58] Field of Search ..... 220/601, 4.05, 4.04, 220/601, 4.05

[56] References Cited

U.S. PATENT DOCUMENTS

| | | | |
|---|---|---|---|
| 4,767,021 | 8/1988 | Pies | 220/601 X |
| 4,776,479 | 10/1988 | Schütz | 220/4.05 |
| 4,934,551 | 6/1990 | Büdenbender | 220/601 |
| 5,014,873 | 5/1991 | Clemens et al. | 220/601 |
| 5,044,510 | 9/1991 | Schütz | 220/4.05 |
| 5,071,028 | 12/1991 | Murphy | 220/4.05 X |

*Primary Examiner*—Steven M. Pollard

*Attorney, Agent, or Firm*—Kane, Dalsimer, Sullivan, Kurucz, Levy, Eisele & Richard

[57] ABSTRACT

A one-piece plastic drum is formed with a top, bottom and sidewall. The top is profiled to form a sump around an access opening so that when the drum is turned upside down, all the liquids are dispensed from the drum.

8 Claims, 2 Drawing Sheets

PLASTIC DRUM WITH SUMP AND METHOD OF MAKING THE SAME

BACKGROUND OF THE INVENTION

A. Field of Invention

This invention relates to a unitary plastic drum for shipping and storing various materials, and more specifically to a plastic drum for liquid materials, which drum has a sloping top with a sump formed about the drum open holes so that all the liquid can be removed out efficiently.

B. Description of the Prior Art

Plastic drums are used frequently to ship and store various materials. These types of drums are preferred over metal drums because they are simpler and cheaper to make, easier to handle, and weigh less. Frequently, plastic drums are used to ship liquid materials used in agriculture, or the chemical industry which are highly concentrated and therefore, must be diluted. Since these liquids are very expensive, it is important that all the contents of the drum be removed before the drum is discarded or returned, to eliminate waste. Frequently, a plastic drum is emptied by turning it upside down. However, until now plastic drums were shaped so that it was impossible to empty their contents 100%.

Hence, there is a great need in the art for a plastic drum which could be emptied efficiently or by turning it upside down.

OBJECTIVES AND SUMMARY OF THE INVENTION

In view of the above-mentioned disadvantages of the prior art, it is an objective of the present invention to provide a plastic drum which can be efficiently emptied by turning it over.

Yet a further objective is to provide a plastic drum which can be made efficiently and economically for example by blow molding.

Another objective of the invention is to provide a drum which can be emptied efficiently using standard equipment.

Other objectives and advantages of the invention shall become apparent from the following description of the invention. Briefly, a plastic drum constructed in accordance with this invention consists of a substantially cylindrical plastic body having a straight cylindrical side, a top and a bottom. At least one access hole is provided on the top for filling and emptying the drum. The top is profiled or contoured to form a sump which is concentrically disposed around the access hole whereby as the drum is turned over, all the liquid collects in the sump and then it runs out through the access hole. The drum is originally formed with a top and a bottom chime for protection as well as to insure that the drum stands upright or vertical when resting on a horizontal surface, and ease of handling.

DETAILED DESCRIPTION OF THE INVENTION

Figure 2:
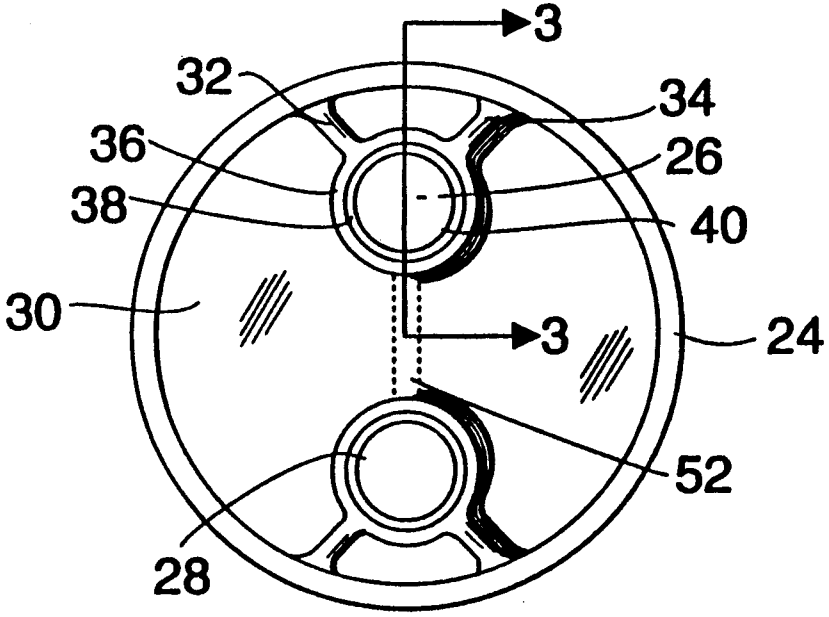
FIG. 2 with a closure caps applied shows a top view of the drum with closure caps removed.

Referring now to the drawings, a drum 10 constructed in accordance with this invention consists of a top 12, a bottom 14 and a substantially cylindrical sidewall 16. Sidewall 16 is formed with two rings 18, 20 provided substantially equidistant from the top 12 and bottom 14 respectively to allow the drum to be rolled on the ground and to reinforce the sidewall 16. At the top 12, the drum 10 is provided with a narrow neck 22 and a chime 24 which permits the handling of the drum by mechanical means such as a parrot-beak, or forklift handling.

Figure 3:
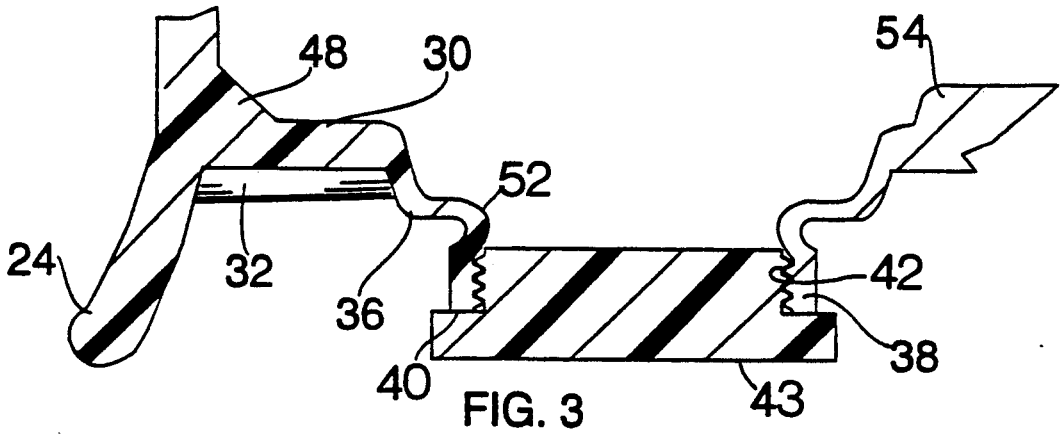
FIG. 3 shows a partial cross sectional view of the drum turned upside down taken along lines 3—3 in FIG. 2.

As seen more clearly in FIG. 2, top 12 is provided with two access holes 26, 28 disposed at a predetermined distance from the longitudinal axis of the drum. The structure of the top surrounding these holes is substantially identical. Except as described below, inner surface 30 of the top 12 is relatively smooth and is pitched toward one of the openings 16, or 18. Starting from chime 24 two raised portions 32, 34 extend toward and join a raised ring 36. A cylindrical relatively thin wall 38 rises straight up from the ring 36 to form a mouth for the drum. The wall 38 has a radial ledge 40 which forms the top of threads 42 (seen in FIG. 3 and 4) disposed helically around the inside of wall 38.

Figure 4:
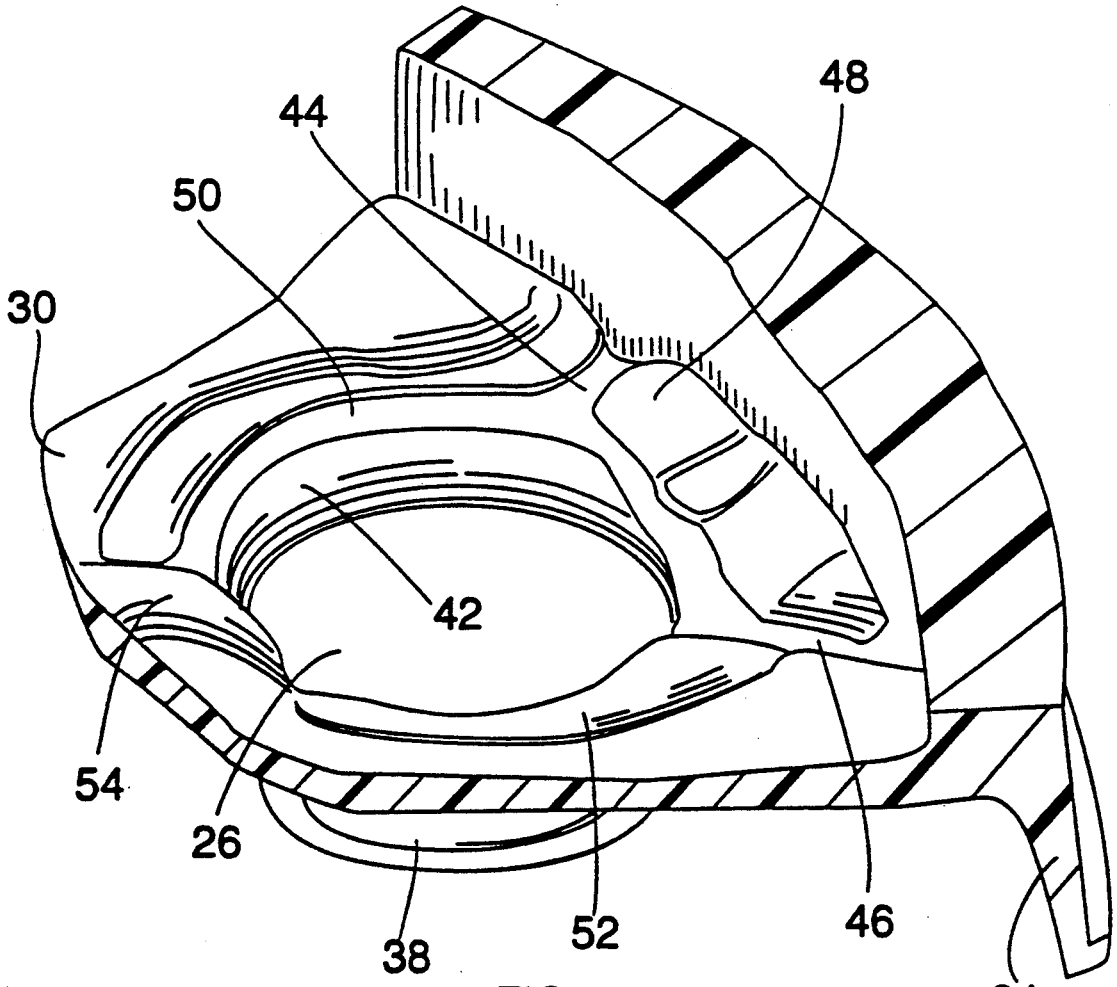
FIG. 4 shows a partial section orthogonal view of one of the openings for inside the drum.

As seen more clearly in FIG. 4, when the drum is turned upside down, portions 32, 34 form on the inside surface of the top 12 two corresponding channels 44, 46 separated by a ramp 48. Moreover, the inner surface of the top is profiled under ring 36 with two arcuate zones 50, 52 disposed below the level of the channels and forming with channels 44, 46 a two-tiered sump for the drum.

Finally a spine 54 is provided on the inner surface 30 between the two openings for reinforcement.

Figure 1:
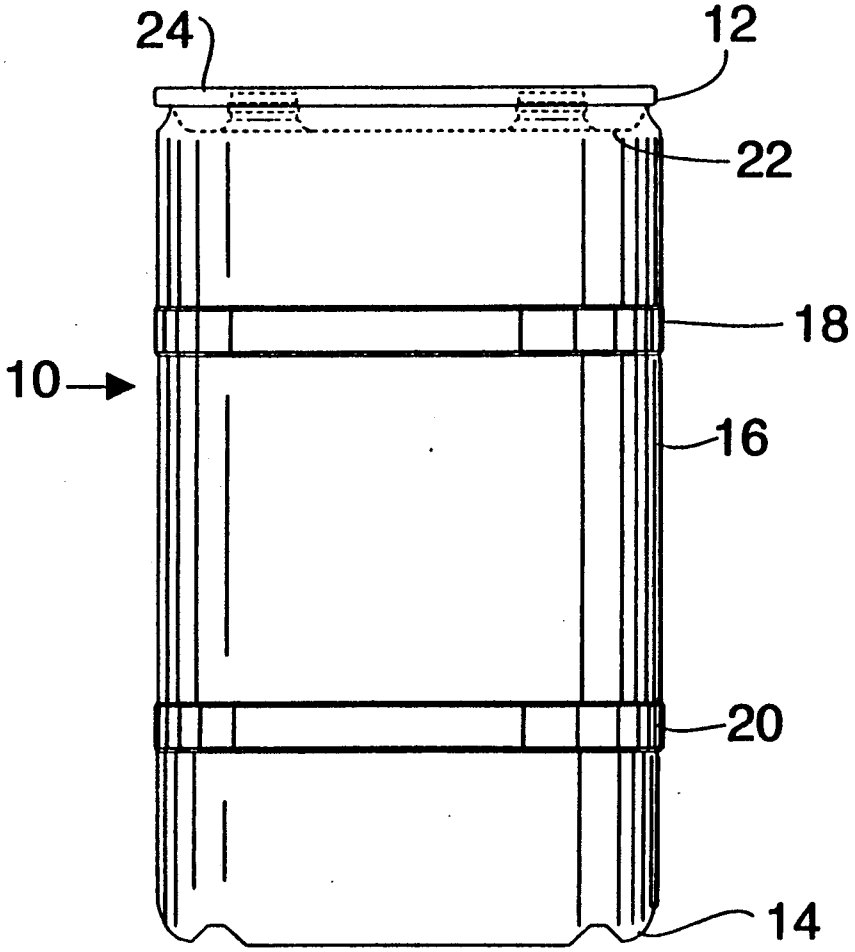
FIG. 1 shows an elevational view of a drum constructed in accordance with this invention.

The drum constructed as described above is used as follows; The drum is placed in the upright position shown in FIG. 1, and is filled with a liquid material such as a herbicide or a pesticide through one of the openings, such as 16. The other opening, 18, is left open for venting. After the drum 10 has been filled, both opening are closed by standard caps 38 which may be secured to the respective opening by engaging internal threads 42.

In order to dispense the liquid from the drum, its caps 38 are removed and the drum is turned upside down to allow the liquid to flow out through either or both openings 26, 28. Importantly, as the drum empties, drops of the fluid run down inside sidewall 16 and because of the profiled top surface 30, they are collected into the sumps formed therein by the channels 44, 46 and arcuate zones 50, 52 and flow out of the openings. In this manner, and because the drum has no crevices or holes in which the fluid can remain as the drum is in its upside down position, all the fluid can be safetly and economically removed from the drum. The drum can then be returned for reuse as is, or can be melted down and recycled.

Preferably the drum is a one piece drum made for example by blow molding.

Obviously, numerous modifications may be made to this invention without departing from its scope as defined in the appended claims.

What is claimed is:

1. A blow molded one-piece plastic drum capable of having all liquids contained therein to be removed out therefrom when then drum is turned upside down comprising:

a top, a bottom and a tubular integral sidewall cooperating to form a unitary drum body; and a mouth extending downwardly from the top when the drum is in an upside down position and defining a first access opening formed in said top; said top having an inner surface pitched downwardly towards said first access opening when the drum is in an upside down position, a ring profiled about said first access opening and interposed between the top and mouth, at least one channel formed in the top and extending below the top inner surface and extending from the sidewall into the ring when the drum is in an upside down position to form a first tiered sump, at least one arcuate zone between the ring and mouth and beneath the ring when the drum is in an upside down position to form a second tiered sump, the sumps being arranged and constructed to collect liquid from said drum and dispense said liquid from said drum through said first access opening when said drum is turned upside down to remove all the liquid from the drum, whereby as the drum empties, drops of the liquid run down the inside of the sidewall and top and because of the pitched inner surface of the top, they are collected into the channel and arcuate zone and flow out of the access opening and in this manner, and because the drum has no crevices or holes in which the fluid can remain as the drum is in its upside down position, all the liquid can be safely and economically removed from the drum and the drum can then be returned for reuse or melted down and recycled.

2. The drum of claim 1 wherein said first tiered sump includes a pair of said channel separated by a ramp and the second tiered sump include a pair of said arcuate zones disposed below said channel to receive liquid collected in said channel and direct the liquid to the access opening.

3. The drum of claim 1 further comprising a second access opening having said first tiered and second tiered sumps.

4. The drum of claim 3 wherein said access openings are disposed at a preselected distance from the longitudinal axis of said drum.

5. The drum of claim 4 wherein the inner surface of the top is pitched downwardly toward both of the access opening when the drum is in an upside down position.

6. The drum of claim 5 wherein a spine is formed in the top between the access openings for reinforcing.

7. The drum of claim 1, wherein the mouth is provided with internal threads and an externally threaded closure cap closes the access opening.

8. The drum of claim 1, wherein a chime extends upwardly from and circumferentially around the top beyond the mouth for permitting the handling of the drum by mechanical means.

* * * * *